US009102140B2

(12) United States Patent
Beckmann et al.

(10) Patent No.: US 9,102,140 B2
(45) Date of Patent: Aug. 11, 2015

(54) PRINTING APPARATUS

(71) Applicants: Stefan Beckmann, Falkensee (DE); Wolfgang Muhl, Hohen Neuendorf (DE)

(72) Inventors: Stefan Beckmann, Falkensee (DE); Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 0 days.

(21) Appl. No.: 14/535,367

(22) Filed: Nov. 7, 2014

(65) Prior Publication Data

US 2015/0158290 A1 Jun. 11, 2015

(30) Foreign Application Priority Data

Dec. 6, 2013 (DE) ..... 20 2013 105 555 U

(51) Int. Cl.
*B41J 15/00* (2006.01)
*B41J 2/045* (2006.01)

(52) U.S. Cl.
CPC ..... *B41J 2/04501* (2013.01)

(58) Field of Classification Search
CPC ..... B41J 11/007; B41J 15/04; B41J 15/048; B65H 2701/1916; B65H 3/56; G07B 17/00467; G07B 2017/00241; G07B 2017/00516; G07B 17/00; G07B 17/00193; G07B 2017/00523; G07B 17/00508
USPC ..... 347/4, 5, 9, 19, 20, 37, 101, 104, 105, 347/108
See application file for complete search history.

(56) References Cited

U.S. PATENT DOCUMENTS

| | | | | |
|---|---|---|---|---|
| 6,755,494 | B2 * | 6/2004 | Park | 347/4 |
| 8,668,329 | B2 | 3/2014 | Ortmann et al. | |
| 8,702,229 | B2 | 4/2014 | Ortmann et al. | |
| 2013/0135416 | A1 | 5/2013 | Muhl et al. | |

FOREIGN PATENT DOCUMENTS

CA 2 797 331 A1 6/2013

* cited by examiner

*Primary Examiner* — Thinh Nguyen
(74) *Attorney, Agent, or Firm* — Schiff Hardin LLP

(57) ABSTRACT

A printing apparatus has an ink printing device onto which a flat item being transported om the x-direction for printing thereon is pressed by a contact pressure device, wherein the base of the contact pressure device has a contact pressure body floor plate biased by a spring force. A notch at the edge of the contact pressure body floor plate extends further in the contact pressure body in the z-direction, up to the ink printing device. An additional contact pressure device for strip-shaped printing substrates has a contact pressure element designed so as to be movable separate from the contact pressure body, and biased with a spring force of an additional spring or resiliently elastic element. The contact pressure element is arranged so as to be movable in the notch. A sensor for print triggering is arranged at a front wall of a lower housing shell of the printing apparatus and has a sensor region that is adjacent to the separate contact pressure element in the insertion direction y of a box-shaped module.

10 Claims, 8 Drawing Sheets

FIG. 8b
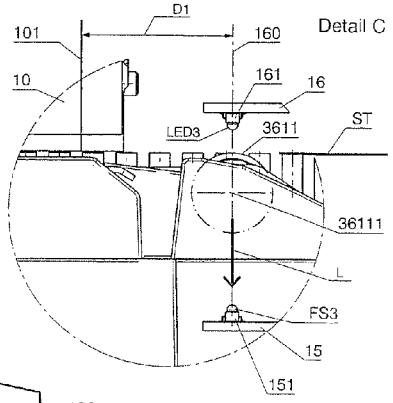
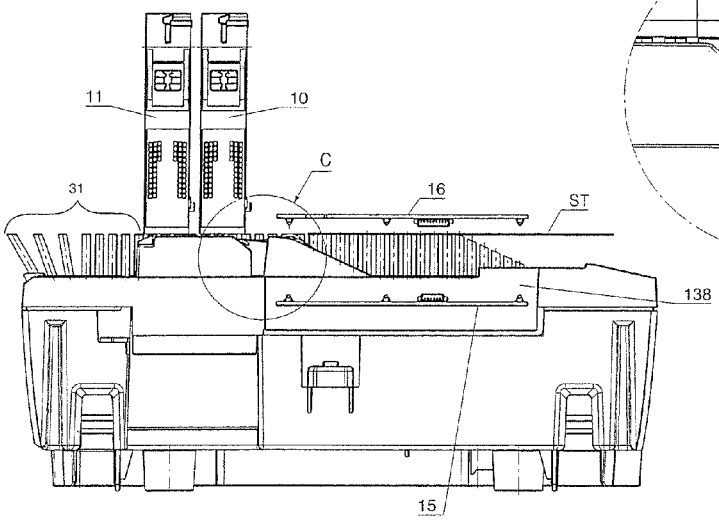
FIG. 8a

PRINTING APPARATUS

BACKGROUND OF THE INVENTION

1. Field of the Invention

The invention concerns a printing apparatus of the type having a separate contact pressure element for franking strips. Such a printing apparatus has a removable, box-shaped module at the lower part of a housing and a transport device with a transport belt in the upper part of a housing, wherein mail pieces are transported in a gap between the two parts. The printing apparatus is connected with mail processing apparatuses, in particular for use in a franking machine.

2. Description of the Prior Art

As used herein, a mail piece is a printing substrate such as a letter or a small width, elongated length printing substrate such as franking strips, or another flat good that has three dimensions and that is suitable for receiving print indicia.

A printing apparatus of modular design with a removable, box-shaped module is known from German Utility Patent DE 202010015354 U1, in which contact pressure elements are provided in order to press a flat item onto a transport belt from below (FIGS. 1*a* and 1*b*).

From German Utility Patent DE 20201001535101, a device is known to lower, position and raise contact pressure elements of a printing apparatus. This has two guide channels, a rocker and connection elements, as well as shaped parts, and, together with the box-shaped module in the lower part of the franking machine, can be completely removed from the franking machine at the front in order to facilitate or accelerate a dust cleaning. The rocker must be operated to lower the contact pressure device and before a removal of the box-shaped module. The guide channels and the remaining aforementioned components interact with two guide elements that project from the lower part of the printing apparatus. Due to a contour of the guide elements, during the sliding of the box-shaped module into the printing apparatus the contact pressure device is initially moved counter to the z-direction (i.e. downwardly) and then in the z-direction (i.e. upwardly) upon reaching a predetermined feed position.

German Utility Patent DE 202011109208 U1 discloses a printing apparatus wherein a brush body is mechanically coupled with a spring system that has a number of spring elements that are arranged between a base plate and a ground plate. The spring elements are compression springs with a spring constant that is so small that the brush body placed on the base plate is deflected counter to the elastic force of the spring elements in the event that a very thin flat item is transported further via the transport belt. The compression springs of the contact pressure device are pre-tensioned to a minimum contact pressure force of F2min, which is just sufficient in order to transport thin flat items such as franking strips without the brush elements of the brush being deformed. Due to the small spring constant of the compression springs, the deflection thereby takes place before the brush elements of the brush can yield. The spring force increases linearly with the thickness of the flat item, up to a value F2max. Only then at the spring force F2max=F1min are the brush elements effective because the resilience of the spring elements is limited to F2max. The spring force of the brush elements increases exponentially with the thickness of the flat item up to a value F1opt. Given a thick item (such as letters of 3 mm) an additional spring system is active that is arranged below the first spring system between the ground plate and a floor plate of the housing. The spring elements of the additional spring system are likewise compression springs, but with a spring constant that is larger than that of the compression springs of the first spring system, such that at F1opt=F3min, the brush elements for the deflection of the brush body are increasingly ineffective counter to the spring force, because the resilience due to the spring elements of the additional spring system is transitioned into a force range as of F3min. The spring force now additionally increases linearly with the thickness of the flat item up to a value of F3max. This solution has been optimized for thick flat goods and for a long service life of the brush. However, a disadvantage can occur in the event that a very thin flat good (such as a franking strip) should be transported further via the transport belt. Then the force effect F2max must be adjusted in an incremented dosed manner (which is complicated) so that a slippage at the transport belt is avoided in the transport of the franking strip.

In German Utility Patent DE 202011108254 U1 an arrangement is proposed for printing on strip-shaped printing substrates. The printing substrates are transported in a direction designated as the x-direction of a Cartesian coordinate system by a known transport module with a tensioned transport belt revolving by being driven by rollers, and with a counter-pressure device with elastic, elastically arranged contact pressure elements, the printing substrates are printed by a print head located behind a printing window. A module with a magazine for strip-shaped printing substrate is arranged in the entrance region for the printing substrate and in the engagement region of the transport belt. The transport belt of the transport module simultaneously serves as a pull-off device. Each strip-shaped printing substrate has a border region and a printing region, with the border region amounting to at least one third of the printing region width. The module with the magazine is arranged laterally offset from the transport belt (see FIG. 2) so that the printing substrates are engaged by the transport belt only in the border region, and are wider by the amount this border region than the width that would otherwise typically be the widest strip-shaped printing substrate. The transport belt runs outside of and next to the printing window, and the printing substrate with the remaining region to be printed is directed by the transport belt below the printing window. A transport module lies on a lateral letter run guide, and opposite this is situated a counter-pressure device, wherein a printing substrate is transported further while clamped between the aforementioned two means during the printing. A disadvantage of this solution is the engagement of a strip-shaped printing substrate (franking strip) only in the border region, wherein a printing takes place in a wider printing region of the strip-shaped printing substrate. This is solved in precisely the reverse manner for other (normal) printing substrates such as letters. A franking imprint is printed in a narrow (approximately 1 inch) border region of the letter that is predetermined by the postal authority, while the letter is engaged in a remaining region that is wider than the border region. By interaction with the adjustably set force effect of the spring force in the range F2min to F2max, the narrower border region of the franking strip can have a disadvantageous effect on the setting of a slip-free transport, so that an offset of the imprint appears in the print image.

The printing apparatus is equipped with an ink printing device on which a flat item is pressed in a known manner by means of a contact pressure device. The ink printing device has exchangeable ink cartridges and a print head, and the contact pressure device is a component of a box-shaped module that is removable and can be inserted in an insertion direction y. The contact pressure device is charged with a spring force in order to press the flat item onto a transport belt in the contact pressure direction z. A sensor for triggering printing by the ink printing device is arranged in the transport path. During transport in the transport direction x along the transport path, the flat item is printed by the ink printing device.

SUMMARY OF THE INVENTION

There is a need to improve the transport function of such a printing apparatus for strip-shaped printing substrates in a simple manner without negatively affecting the transport and the printing of flat items other than the strip-shaped substrates. A printing apparatus should be equipped to transport strip-shaped printing substrates so as to ensure that the strip-shaped printing substrates are transported without slippage due to pressure triggering and during the printing.

In accordance with the invention, a printing apparatus has a transport mechanism for moving items to be printed in a direction toward an ink printing device, and the contact pressure device through which all items pass that has a contact pressure body floor plate with a notch at the edge thereof, the notch extends further into the contact pressure body in the z-direction, toward the ink printing device. Moreover, an additional contact pressure device is provided for strip-shaped printing substrates that has a contact pressure element that is designed to be movable separate from the contact pressure body, and that is biased with a spring force by an additional spring or spring-biased element. The separate contact pressure element of the additional contact pressure device for strip-shaped printing media is arranged in the notch so as to be movable. The sensor for pressure triggering is arranged on the front wall of the lower housing shell of the printing apparatus and has a sensor region that is adjacent to the separate contact pressure element in the insertion direction y of the box-shaped module.

It has empirically been found that slippage in the transport of a strip-shaped printing substrate must be avoided by the separately movable contact pressure element only when pressure triggering of the printing substrate is occurring in order to ensure an uncomplicated transport function for strip-shaped printing substrates as well during the printing. In contrast to the remaining contact pressure elements of the contact pressure body, the contact pressure element that is arranged nearest upstream (in terms of the mail flow) to a sensor for the pressure triggering in the transport path was designed to be separately movable. For such a separate contact pressure element which is not mechanically connected with the contact pressure body and that is pressed with a larger or equally large spring force F as the contact pressure body, a higher contact pressure therefore already results since the contact pressure area of the separate contact pressure element is theoretically a line, and therefore is smaller than the total contact pressure area of the contact pressure body. A contact pressure device for strip-shaped printing substrates with a separate contact pressure element is therefore achieved in three variants.

In a first variant and third variant, the separate contact pressure element is pivoted as controlled by a control unit. The movement of the separately movable contact pressure element can therefore be controlled in order to only generate a contact pressure by means of the separately movable contact pressure element when this is required while a strip-shaped printing substrate is being transported.

In a second variant, the separate contact pressure element is already pivoted by the control unit due to a kinematic coupling of mechanical components of the printing apparatus and of the box-shaped module when said box-shaped module is inserted into the printing apparatus. A roller borne so as to be rotationally movable on an axle is used in order to avoid an unnecessary friction of the separately movable contact pressure element and of the transport belt of a transport device.

The remaining contact pressure elements are mechanically connected with one another on a side facing away from the contact pressure surface, and therefore are moved together toward the transport belt (i.e. in the z-direction) by a spring force while being pressed upon. In the following, a contact pressure device for flat goods is discussed, in contrast to the contact pressure device for strip-shaped printing substrates. The spring force is limited to a minimum value F2min during the pressing of the contact pressure device for flat goods if no flat good is transported. A maximum spring force F2max is active if a few contact pressure elements are already pushed down because a thin flat good enters into a gap between the transport belt and the contact pressure elements and is transported further in the transport direction x, wherein the thickness of the thin flat good reaches but does not exceed a predetermined maximum thickness of strip-shaped printing substrates. Given the spring force F2max=F1min, individual contact pressure elements of the contact pressure device for flat goods are pushed down in succession in the aforementioned gap, which increases the contact pressure of the contact pressure device on the thin flat good in very small stages. Due to the multiple contact pressure elements, only very small impacts thereby occur on the thin flat good. The impacts lead to transport delays, but they are so small that these are no longer visible in the print image. The aforementioned separate contact pressure element also causes an impact upon engagement of the leading edge of the of the strip-shaped printing substrate. However, this single impact cannot affect the print image because the printing to the strip-shaped printing substrate has not yet begun then. The contact pressure due to the separate contact pressure element is greater than or equal to the contact pressure due to the total contact pressure area of the contact pressure body. The separate contact pressure element is advantageously a roller. A printing start sensor is arranged near the axle of the roller of the contact pressure device for strip-shaped printing substrates, advantageously below an axial line extended from the axle. The start of the printing of the strip-shaped printing substrate is triggered by a control unit with a delay of a defined path length.

BRIEF DESCRIPTION OF THE DRAWINGS

FIG. 8*a* is a view of the box-shaped module from the rear that is inserted into the printing apparatus, with a contact pressure body that is mounted on the receptacle carrier, and with a contact pressure device for strip-shaped printing substrates, as well as with a sensor support plate.

FIG. 8*b* is a view of detail C from the view according to FIG. 8*a*.

DESCRIPTION OF THE PREFERRED EMBODIMENTS

Figure 1A:
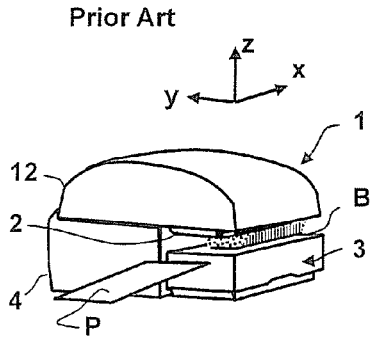
FIG. 1*a* is a perspective view of a known printing apparatus with inserted box-shaped module, from the front upper left.

FIG. 1*a* shows a perspective view of a printing apparatus 1 from the front upper left, with an inserted box-shaped module 3 that is docked at a lower housing shell 4 below an upper housing shell 12, and in which contact pressure elements B are provided in order to press a flat good P from below onto a transport belt 2 arranged in the upper housing shell 12. The contact pressure elements are designed in the form of a brush. An arrow that designates the x-direction of a Cartesian coordinate system points in the transport direction for a flat good. The insertion direction of the box-shaped module is identified by an arrow in the y-direction, and the contact pressure due to the contact pressure elements takes place in the z-direction of the Cartesian coordinate system. This coordinate system is also retained in the following.

Figure 1B:
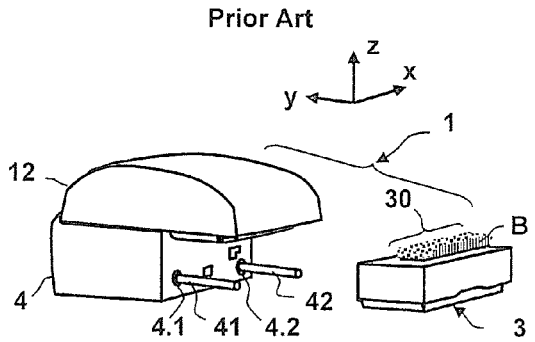
FIG. 1*b* is a perspective view of the known printing apparatus with a removed box-shaped module, from the front upper left.

FIG. 1*b* shows a perspective view of a printing apparatus 1 from the front upper left with a removed box-shaped module 3. Two guide elements 41 and 42 that are designed as rails are visible on the front side of the lower housing shell 4. They protrude forwardly through a first opening 4.1 and a second opening 4.2 on the front side of the lower housing shell. Upon insertion, and subsequently in the operating mode, the box-shaped module 3 is supported on the guide elements. A contact pressure device 30 of the box-shaped module has a spring-biased brush with a number of contact pressure elements B that project upwardly through an opening in the upper housing part of the box-shaped module.

Figure 2A:
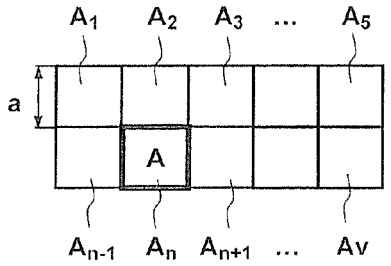
FIG. 2*a* is a plan view of a complete contact pressure area of contiguous surface elements.

Shown in FIG. 2*a* is a plan view of a complete contact pressure area of in total v contiguous surface elements $A_1, A_2, A_3, \ldots A_{n-1}, A_n, A_{n+1}, \ldots A_v$ of equal size. For simplification, each of the surface elements A is quadratic and has an identical edge length a. The surface elements A are arranged in two lines, one below the other, and contact the respective immediately adjacent surface element. A force acting on a surface of a contact pressure body is understood in the following as a contact pressure force. The contact pressure $P_{ges}$ is proportional to the contact pressure force (spring force) and inversely proportional to the effective total contact pressure area $A_{ges}$.

The contact pressure body distributes the contact pressure force F on v contact pressure surfaces A. Given an edge length a=15 mm and v=24 contact pressure surfaces that are arranged in two lines of 18 cm in length, a total contact pressure area $A_{ges}$=54 cm$^2$ results. The contact pressure body has a total contact pressure area $A_{ges}$, and Equation (1) applies:

$$P_{ges}=F/A_{ges}=F/(v\cdot A) \tag{1}$$

In simplified form, in the plan view a contact pressure surface (thick border) of a contact pressure element is also depicted as a rectangle within the number v identical contact pressure elements A. Such a contact pressure surface can be defined overall within the complete contact pressure surface $A_{ges}$.

Due to the number of contact pressure elements of the contact pressure device for flat goods, for example the of bristles of a brush, wherein for simplification a quadratic cross section is assumed instead of the round bristle cross section, a complete contact pressure surface that is composed of a plurality of individual contact pressure surfaces can approximately be assumed. A contact pressure surface with approximately quadratic cross section can likewise be formed via a bundling of multiple bristles. Such contact pressure surfaces, which are preferably of identical size, logically have a much greater contact pressure area than would be achievable with a single bristle cross section. A number of equally large contact pressure elements with such a contact pressure surface that is much larger due to the bundling can likewise be assembled into a total contact pressure surface. From this total contact pressure surface, a contact pressure surface is cut out in which the separately movable contact pressure element is active with regard to a strip-shaped printing substrate (franking strip), precisely only in the border region of the strip-shaped printing substrate which is not printed.

Figure 2B:
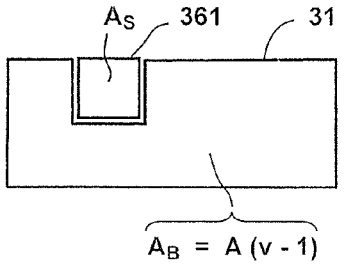
FIG. 2*b* is a plan view of a separate surface element and of a complete contact pressure area of contiguous surface elements.

In FIG. 2*b*, a plan view of a separate surface element and a total contact pressure surface of contiguous surface elements is shown. For example, the separate surface element $A_S$ is the contact pressure surface of the separate contact pressure element 361 which is arranged in a notch of a contact pressure body 31 is as to be movable independently of such contact pressure body. The separate contact pressure element 361 preferably has a somewhat smaller area than the surface element A of FIG. 2*a*. If the area of the separate contact pressure element is cut out, given in total v−1 contiguous surface elements the remaining surface elements A in the arrangement of FIG. 2*b* then yield a total contact pressure area according to Equation (2):

$$A_B=A(v-1) \tag{2}$$

The contact pressure body 31 distributes the contact pressure force F to v−1 contact pressure surfaces A. The contact pressure for the common arrangement of contact pressure elements according to FIG. 2*b* is therefore increased relative to the arrangement according to FIG. 2*a*.

The contact pressure area $A_S$ of a separate contact pressure element 351 can deviate from the quadratic shape. The separate contact pressure element 361 can also be assembled from a number of contact pressure elements or be of other design, for example as a roller or skid. The separate contact pressure element 361 is mounted or advantageously at least partially molded on a support. For a separate contact pressure element $A_S$ which is mechanically not connected with the contact pressure body 31 and that is pressed with an equally large spring force F as the contact pressure body 31—but without the contact pressure force being distributed—a contact pressure that is v-times higher results according to Equation (3):

$$P=F/A_S \text{ with } A_S=A_{ges}/v \quad (3)$$

Figure 3:
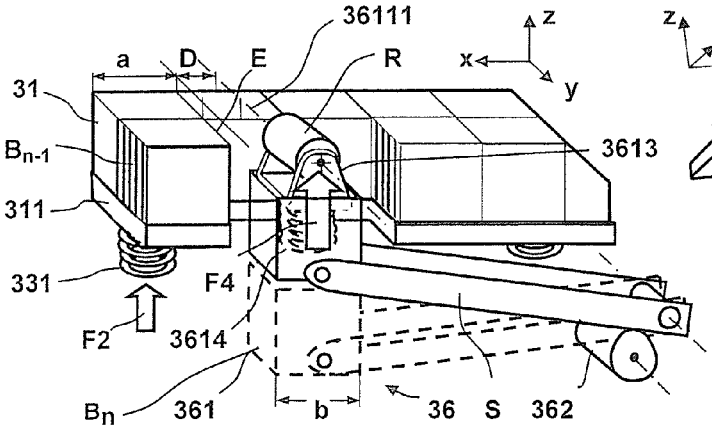
FIG. 3 is a perspective view of a first variant of a contact pressure device for strip-shaped printing substrates according to the invention, from the upper rear.

FIG. 3 shows a perspective view of a contact pressure device 36 for strip-shaped printing substrates according to a first variant, from the rear top. For example, an elastically borne roller R is used in connection with or, respectively, as a separate contact pressure element for strip-shaped printing substrates in a notch of the contact pressure body 31. This roller is installed so as to be rotatable on an axle 36111 running parallel to the y-direction. A sensor region of a print start sensor is arranged (the manner is not shown) adjacent to the separate contact pressure element 361 with the roller R in the insertion direction y of the box-shaped module. The print start sensor detects the leading edge of the printing substrate reaching a position for the triggering of the printing of said printing substrate. An edge E of a contact pressure surface of the contact pressure element $B_{n-1}$ that follows the separate contact pressure element in the transport direction x (which edge E runs parallel to the y-direction) preferably likes at a distance D (preferably approximately one half the edge length b) from the axle 36111 of the roller R, wherein b is the edge length of the separate contact pressure element in the transport direction. The edge of the notch 312 (see FIG. 4) that is placed downstream in terms of the mail flow lies parallel to the edge E of a single surface element $A_{n-1}$ of the contact pressure element $B_{n-1}$. This edge E lies to one side of the contact pressure element $B_{n-1}$, wherein the side lies closest to an edge of the notch that is situated downstream in terms of the mail flow. The edge E can be extended with a line in the insertion direction (i.e. in the y-direction) and lies orthogonal to the transport direction x. The aforementioned extended line lies parallel to the axle 36111 that is extended upstream (in terms of the mail flow) and, in the transport direction x, has a distance D relative to said extended axle 36111. The radius r of the roller 3611 corresponds to a fraction of the edge length b of the separate contact pressure element. The width of the notch is dependent on the diameter of the roller and is chosen to be greater than b. For example, given v=14 identical quadratic contact pressure surfaces per line, given a double line arrangement with an edge length a=5 mm the distance D is in a range from 5 mm to 7 mm for b<a, for example. Resulting from this is a possible radius r of 5 to 7 mm for the roller R. Outside of the contact pressure element $B_n$, all remaining contact pressure elements B of the contact pressure body 31 are installed on a contact pressure body floor plate 311 or, respectively, are solidly connected with one another at their base. In the example shown in FIG. 2*b*, a separate contact pressure element 361 is provided with a much smaller contact pressure area instead of the contact pressure element B. A contact pressure element that is situated upstream (in terms of the mail flow) of the separate contact pressure element 361 of the contact pressure body 31 can be omitted, as shown in FIG. 3. This is necessary if the radius r of the roller is chosen that is greater than half of the edge length b of the separate contact pressure element, i.e. given r>½b.

The contact pressure body 31 can have a number of contact pressure elements B, for example in the form of a brush. However, it can also be designed as a bellows or be present in a different shape. The contact pressure elements B of the contact pressure body 31 are pressed against a flat good P with a minimum spring force F2min and at most with a spring force F2max. The spring force grows proportionally with the thickness of the flat good since the contact pressure body floor plate is deflected against the spring force effect, corresponding to the thickness. The contact pressure body is designed as a brush body with a lateral notch. The notch has a sufficient shape and size so that it is ensured that the separate function of the roller is not negatively affected during the pressing of a strip-shaped printing substrate onto the transport belt. The width of the bearing surface of the roller advantageously corresponds to the width of the border region of the strip-shaped printing substrate. The border region is not printed. The width of the bearing surface of the roller R at most is one third of the print region width of the strip-shaped printing substrate. Given use of a roller R, the contact pressure area theoretically shrinks to a line. The roller R is mounted on the axle 36111 that is attached to a support 3613 that can be deflected counter to a spring force F4 of a compression spring 3614. In contrast to the complete contact pressure surface of the contact pressure body 31, the roller R separately elastically acts on the transport belt upon pressing of a franking strip (not shown). The support is arranged at one end of a rocker S. Alternatively, the compression springs 3614 can be omitted if the rocket itself is designed to be elastic. A positioning mechanism 362 is arranged near to the other end of the rocker (which end is mounted such that it can pivot) and is provided in order to press the separate contact pressure element counter to the force of gravity onto a franking strip to be printed, as the positioning mechanism 362 is controlled by a control unit (not shown). For example, the positioning mechanism 362 can be a stepper motor with a camshaft, the latter engaging at the rocker depending on the rotational position of the camshaft. The rocker S rests on the camshaft due to the force of gravity.

Figure 4:
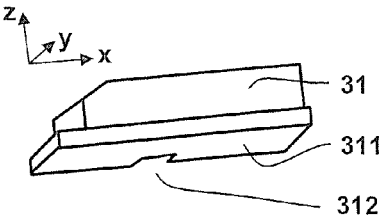
FIG. 4 is a perspective view of a contact pressure device from the front lower left, without the separate contact pressure device.

FIG. 4 is a perspective view of a contact pressure device for flat items, from the front lower left without the contact pressure device for strip-shaped printing substrates being shown. A notch 312 at the edge of the contact pressure body floor plate 311 continues in the z-direction in the contact pressure body 31. The notch of the contact pressure body is shaped on an edge of the contact pressure body that faces away from the front side of the printing apparatus. For example, the contact pressure body 31 is designed as a brush body which the brush elements in the region of the notch. The brush body is supplemented in a known manner by a double spring system that rests on the floor plate (not shown) of the lower housing shell of the box-shaped module.

Figure 5:
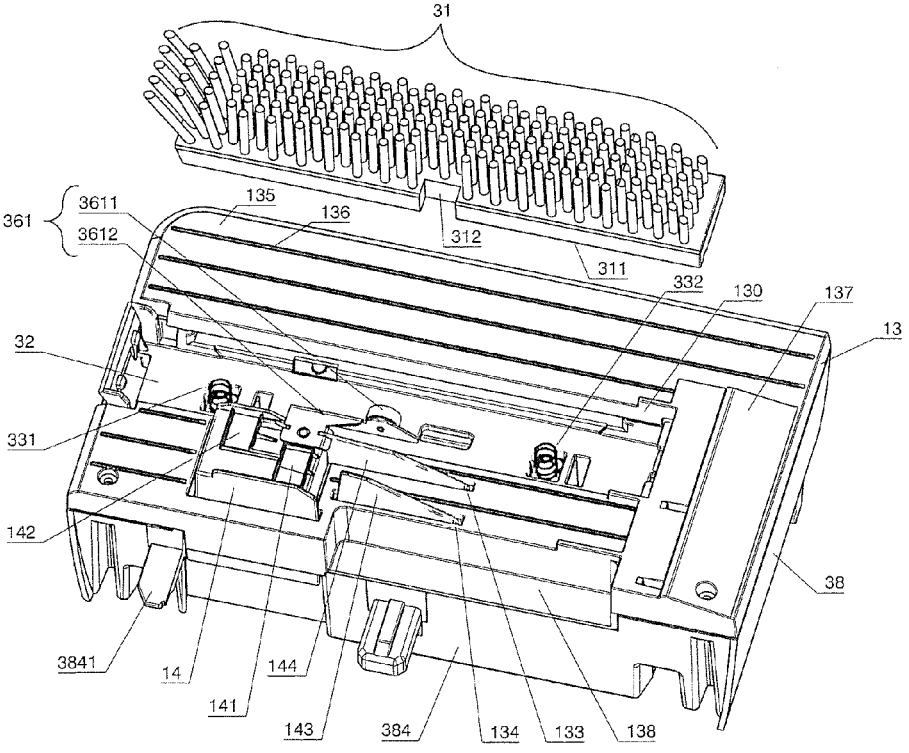
FIG. 5 is a perspective view of a second variant of the contact pressure device for strip-shaped printing substrates according to the invention, from the rear upper left.

In FIG. 5, a perspective view shows a second variant of the contact pressure device for strip-shaped printing substrates from the upper rear. The upper part of the box-shaped module is designed as a feed table 13 in which a common opening is provided for the separate contact pressure element 361 and for the contact pressure body 31. The separate contact pressure element 361 includes the roller 3611 that is mounted so as to be rotatable on an axle that is attached to an angle plate 3612 that is provided for mechanical coupling of the roller 3611 with a shaft support 14. The feed table 13 is mounted on a lower housing shell 38 of the box-shaped module. The roller 3611 mounted on the angle plate 3612 protrudes into the space above the opening 130 in the region of the notch 312 of the contact pressure body floor plate 311. Additional openings 133, 134 in the feed table 13 are provided for the guide fins 143, 144 of the shaft support 14. These and the common opening 130 have a rectangular shape. The guide fin 144 of the shaft support 14 can therefore be arranged directly at the edge of the longer side of the common opening 130 and protrudes upward through the opening 134 in the feed table 13. The shaft support 14 has at its movable end a free spraying shaft with two openings 141 and 142 that are respectively provided for an ink print head. The separate contact pressure element 361 advantageously mounted near the guide fin 144 at the free spraying shaft housing. The shaft support is attached so as to be pivotable on the underside of the feed table. A number of contact pressure elements are firmly connected with one another at their base in the contact pressure body floor plate 311, which likewise has a rectangular shape and fits into the opening 130. The contact pressure elements form a contact pressure body 31. The contact pressure body 31 and the contact pressure floor plate 311 are advantageously designed as a brush. According to FIG. 5, the contact pressure body 31 is removed from a from a cavity below the opening 130 and shown at a distance from the feed table so that a receptacle support 32 for the contact pressure body 31 and the two compression springs 331, 332 are therefore visible. Both compression springs are components of a first compression spring system. They are arranged between receptacle support 32 and the contact pressure body floor plate 311 at the underside of the brush body. Given an installed brush body, the compression springs 331 and 332 respectively effectively lie at the two long ends of the underside of the brush body and are installed on the floor of the receptacle support 32. Upstream (in terms of the mail flow), the feed table 13 has an intake in the form of a ramp 137 and slide rails 136 that are arranged on the base plate 135 of the feed table. The feed table has a notch 138 placed on the back side of the box-shaped module, which notch 138 is for a sensor support plate (not shown). The sensor support plate is arranged in a protective housing on the front wall of the printing apparatus (FIG. 9) and protrudes (the manner is not shown) into the notch 138 if the box-shaped module is inserted into the printing apparatus. On the back side 384 of the lower housing shell 38 of the box-shaped module, a cam switch 3841 is molded at the downstream (in terms of the mail flow) side, which cam switch 3841 interacts (the manner is not shown) via an opening with a microswitch arranged behind the front wall of the lower housing shell of the printing apparatus, which signals that the box-shaped module has been properly inserted into the printing apparatus.

Figures 6A, 6B:
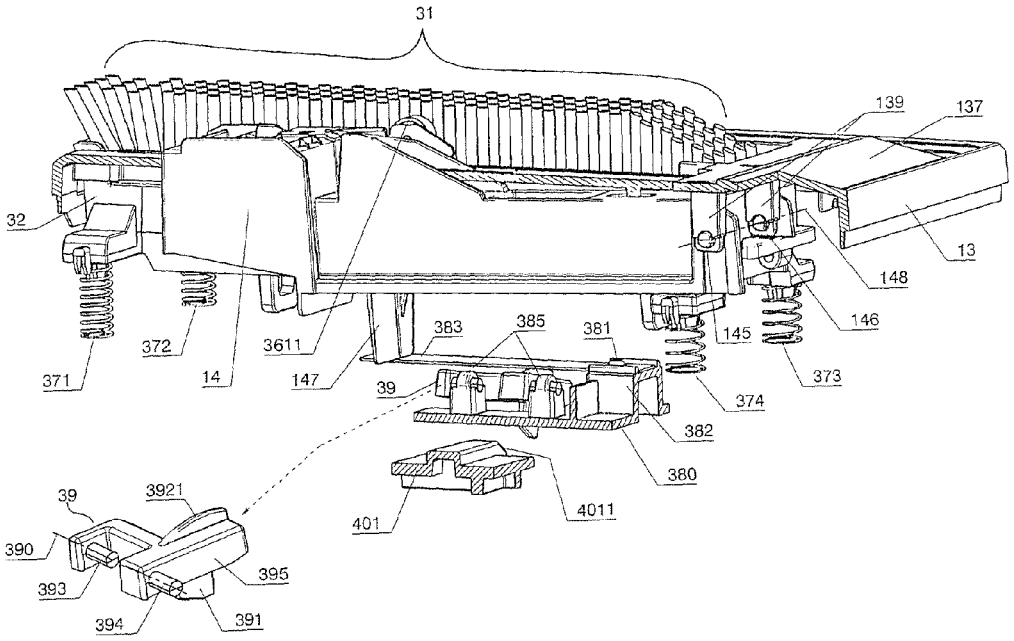
FIG. 6*a* is a perspective view of the second variant according to FIG. 5 with a longitudinal section through the feed table, from the read upper left.
FIG. 6*b* is a perspective view of a deflection arm according to the second variant according to FIG. 5.
Figure 7A:
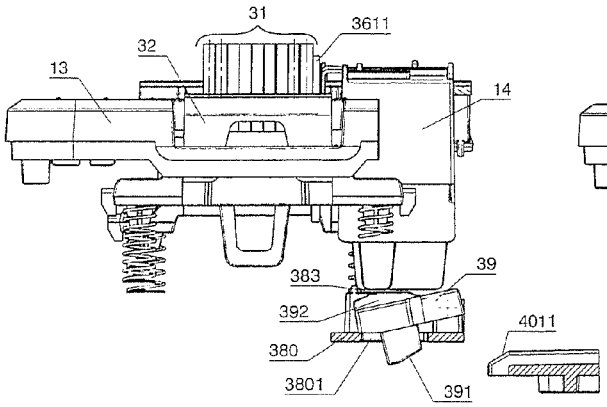
FIG. 7*a* is aside view from the right of a feed table that is sectioned in part, with a contact pressure device for strip-shaped printing substrates, for the case that the box-shaped module is not inserted into the printing apparatus.

Shown in FIG. 6*a* is a perspective depiction of the second variant according to FIG. 5 with a longitudinal section through the feed table 13, from the upper rear left, with a contact pressure body 31 mounted on the receptacle support 32 and with a contact pressure device that has a roller 3611. The compression springs 371 through 374 of the second compression spring system are arranged at the four corners of the underside of the receptacle support 32. However, the compression springs are compressed only given the transport of very thick flat goods. The compression springs (which are also effective for strip-shaped printing substrates) of the first compression spring system are covered by the shaft support in FIG. 6*a* but arise from FIG. 5. The shaft support 14 is mounted so as to be pivotable at the feed table 13, and has an end situated below the ramp 137 of the feed table at which two bearing pins 145, 146 are located. For the bearing pins 145, 146 of the shaft support 14, a bearing point 139 is molded on the underside of the feed table. That enables a pivoting of the shaft support 14 on an axis 148 proceeding through the bearing pins. This axis 148 lies parallel to the y-direction. On the other free end of the shaft support 14, a free running shaft is molded that projects upwardly through an opening in the feed table 13. An attachment block 382 and a slit-shaped opening (FIG. 7*a, b*) are shaped in the floor plate 380 of the lower housing shell of the box-shaped module. The attachment block 382 is provided for the attachment of a leaf spring 383 that is attached at its one end with an attachment means 381 to the attachment block 382 and is freely movable at its other end. On the underside of the shaft support 314, a shaped part 147 is molded which is situated near to the free end of the leaf spring 383, on said leaf spring 383, and serves for force transmission from the leaf spring 383 to the shaft support 14. For force transmission to the leaf springs 383, a deflection arm 39 is used that can be kinematically coupled to a flat placement part 401 upon insertion of the box-shaped module with a ramp 4011. The flat placement part 401 is molded on the front wall of the lower housing shell of the printing apparatus. A bearing point 385 for the deflection arm 39 is also molded on the floor plate 380, near the attachment block 382 and the slit-shaped opening (FIG. 7*a, b*).

FIG. 6*b* is a perspective view of a deflection arm 39 according to the second variant of the invention (see FIG. 5). The deflection arm has a rotation axis 390 that is oriented parallel to the transport direction x given an installed deflection arm 39. In contrast to this, the slit-shaped opening (see FIG. 7*a,b*) in the floor plate 380 of the lower housing shell of the box-shaped module extends orthogonally, i.e. parallel to the y-direction. The deflection arm 39 has a ramp-shaped incline 391 on its single lever arm, the incline 391 protruding downwardly, through the slit-shaped opening in the floor plate 380 of the box-shaped module, given an installed deflection arm 39. The aforementioned lever arm of an installed deflection arm thereby extends forwards and bears a molded contour 3921 that is molded on the side of the deflection arm that is directed upward, wherein the leaf spring rests on the molded contour of an installed deflection arm. The deflection arm body 395 has a mirrored h-shaped design. The deflection arm body 395 transitions into two legs, as they are also visible at the lower end of the h-shape. Molded on the end of the legs are bearing pins 393, 394 that—given an installed deflection arm—lie on an axis 390 parallel to the x-direction and are molded in the x-direction on the deflection arm body 395.

Figure 9:
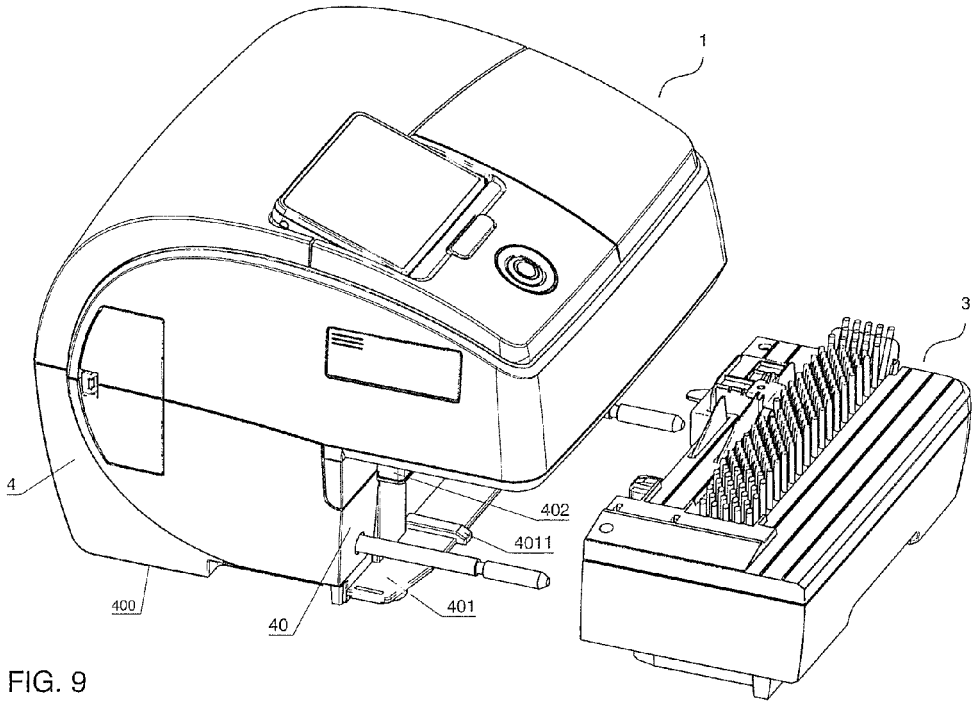
FIG. 9 is a perspective view of a printing apparatus with the box-shaped module removed from the front upper left.

In the plane of a floor plate of the lower housing shell of the printing apparatus, a placement surface piece 401 for the box-shaped module is molded on the front wall of the printing apparatus (see FIG. 9). The placement surface piece 401 has a ramp 4011 that begins flat at the front and rises towards the rear (FIG. 6*a*). The deflection arm 39 is installed in the bearing point at the floor plate 380 of the lower housing shell of the box-shaped module, wherein the ramp-shaped incline 391 of the deflection arm protrudes through the slit-shaped opening (see FIG. 7*a,b*) in the floor plate. The ramp engages with the ramp-shaped run-up incline 391 of the deflection arm when the box-shaped module is slid into the printing apparatus and a kinematic coupling occurs, as a result of which the molded contour 3921 presses onto the middle part of the leaf spring, wherein the installed deflection arm is rotated around the axis 390. The free end of the leaf spring presses with a spring force F5 (see FIG. 6*d*) against the shaped part 147 that is molded on the underside of the shaft support 14. As a result of thus, the roller 3611 installed on the top side of the shaft support 14 is pushed upward, wherein the shaft support 14 is pivoted around an axis of the bearing pins 145, 146 that is situated parallel to the y-axis.

It can be seen from FIG. 6*a* that the roller 3611 is installed on the deflectable shaft support 14, which is attached to the underside of the feed table 13 so as to be pivotable, and which is kept lowered into a lowered position with the leaf spring 383.

Figure 6C:
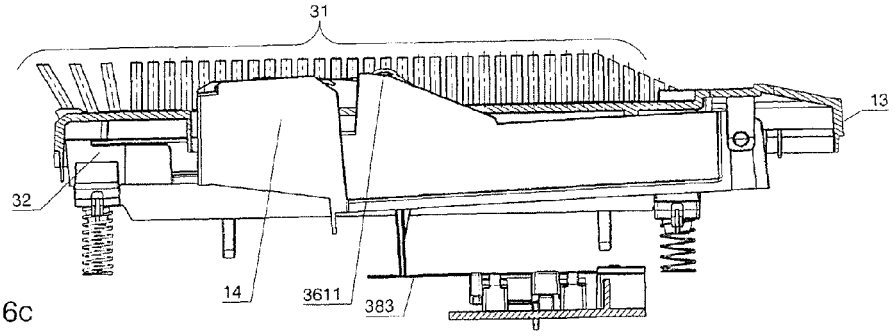
FIG. 6*c* is a longitudinal section through the feed table from the rear, with a contact pressure device for strip-shaped printing substrates, for the case that the box-shaped module is not inserted into the printing apparatus.

A view of a longitudinal section through the feed table is shown from the rear in FIG. 6*c*, which shows a contact pressure body 31 installed on the receptacle support 32 across an opening in the feed table, and a contact pressure device for strip-shaped printing substrates, for the case that the box-shaped module is not inserted into the printing apparatus. As a result of this, the tension of the leaf spring 383 is released, the shaft support 14 is un-pivoted and the roller 3611 is lowered, as was already shown in FIG. 6*a*.

Figure 6D:
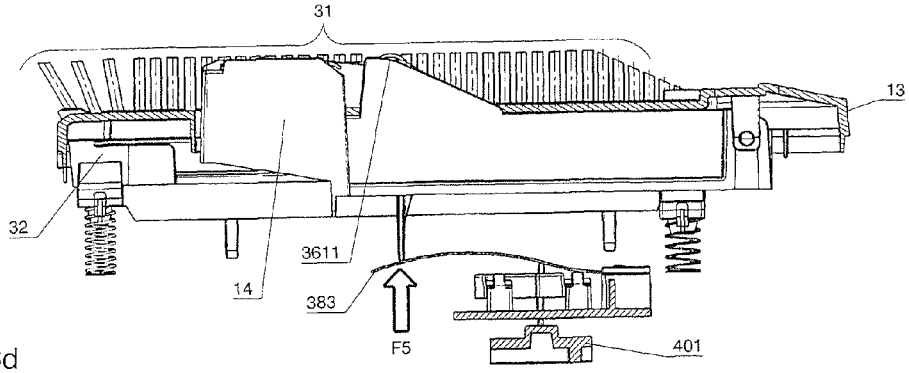
FIG. 6*d* is a longitudinal section through the feed table from the rear, with a contact pressure device for strip-shaped printing substrates, for the case that the box-shaped module is inserted into the printing apparatus.

Shown in FIG. 6*d* is a view of a longitudinal section through the feed table from the rear, which shows a contact pressure body 31 installed on the receptacle support 32 across an opening in the feed table, and a contact pressure device for strip-shaped printing substrates, for the case that the box-shaped module is inserted into the printing apparatus. Of the aforementioned contact pressure device, the roller 3611, the shaft support 15, the leaf spring and the deflection arm (see FIG. 6*b*) are visible. The ramp at the placement surface piece 401—which is arranged (the manner is not shown) at the front wall of the lower housing shell of the printing apparatus for the box-shaped module (see FIG. 9)—and the deflection arm enter into a kinematic coupling due to the insertion, as a result of which the leaf spring 383 is pushed upward (i.e. in the z-direction). The shaft support 14 is pivoted upward and presses with the roller 3611 against the transport belt. The leaf spring 383 is now pre-tensioned with a spring force F5min. A strip-shaped printing substrate now arrives in the gap between roller and transport belt. The spring force F5 with which the roller is charged by the leaf spring 383 is greater than the spring force of the first spring system (see FIG. 5, compression springs 331 and 332) which acts on the contact pressure body. Due the greater spring force and the small contact pressure surface or, respectively, already due to the (theoretical) contact pressure line of the separate contact pressure element, the contact pressure force F5 that is exerted on the border region of the strip-shaped printing substrate (franking strip, for example) is very large. This leads to a greater stiction of the strip-shaped printing substrate on the transport belt. The roller 3611 has only a slight rolling friction. Therefore, a slippage of the strip-shaped printing substrate on the transport belt can be securely avoided during the transport of the printing substrate.

Depicted in FIG. 7*a* is a side view of a feed table 13 that is cross sectioned in part, from the right, which shows a contact pressure body 31 for flat goods—installed on the receptacle support 32—and a contact pressure device for strip-shaped printing substrates, for the case that the box-shaped module is not inserted into the printing apparatus. The leaf spring presses from above onto the contact pressure element 392 of the deflection arm 39. Due to the molded contour 3921 (see FIG. 6*b*) of the contact pressure element 392, the bearing pins (not shown) of the deflection arm 39 that are borne in the bearing point of the floor plate 380 of the lower housing shell are rotated so far that the ramp-shaped run-up incline 391 of the deflection arm protrudes a maximum distance out of the slit-shaped opening 3801 in the floor plate 380. However, the ramp 4011 arranged on the flat placement part 401 is distant from the ramp-shaped incline 391 and has no effect. As a result, the leaf spring 383 is not tensioned, the shaft support 14 is unpivoted and the roller 3611 is lowered.

Figure 7B:
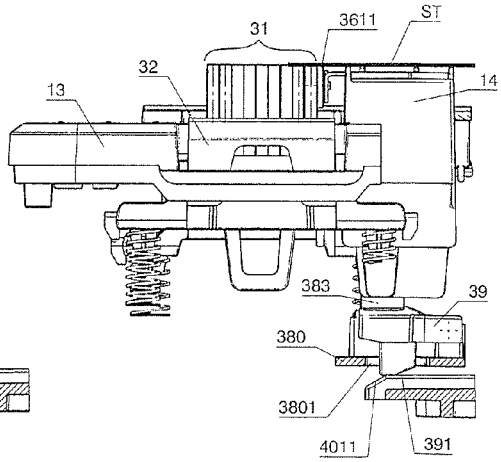
FIG. 7*b* is a side view from the right of a feed table that is sectioned in part, with a contact pressure device for strip-shaped printing substrates, for the case that the box-shaped module is inserted into the printing apparatus.

Shown in FIG. 7*b* is a side view of a feed table 13 that is cross sectioned in part, from the right that shows a contact pressure body 31 installed on the receptacle support 32 and a contact pressure device for strip-shaped printing substrates for the case that the box-shaped module is inserted into the printing apparatus. The ramp 4011 that is arranged on the flat placement part 401 now has an influence on the ramp-shaped run-up incline 391 in that both arrive in engagement with one another. As a result of the insertion, the leaf spring 383 is tensioned, the shaft support 14 is pivoted and the roller 3611 is pressed upward onto a franking strip ST.

FIG. 8*a* shows a view of the box-shaped module from the rear that is inserted into the printing apparatus, with a contact pressure body 31 installed on the receptacle support and with a contact pressure device for strip-shaped printing substrates ST, as well as with a sensor support plate 15 opposite which is arranged an additional support plate 16 for exposure means. Of the aforementioned contact pressure device, only the protruding parts (roller and shaft support) are visible. The ink cartridges 10, 11 and both support plates are components of the printing apparatus, wherein under an upper housing shell (FIG. 1*a*) of the printing apparatus the support plate 16 is arranged above and the sensor support plate 15 is arranged below the gap, between which exist the print heads of the ink cartridges 10, 11 and the contact pressure device 31. Given transport of thick mail pieces, the gap can be up to 10 mm wide, wherein the contact pressure device dodges downward, counter to the aforementioned spring force. The ink cartridges 10, 11 are arranged stationary during the printing. The sensor support plate 15 receives light beams which are situated parallel to the z-direction. The support plate 16 emits light beams that propagate counter to the z-direction. The sensor support plate 15 is arranged in the notch 138 at the back side of the feed table if the box-shaped module is inserted into the printing apparatus. The sensor support plate 15 is accommodated in a protective housing (FIG. 9) and extends in the transport direction x up to its one end near the print head of the ink cartridge 10. The sensor support plate 15 has a print start sensor 151 mounted thereon near its downstream (in terms of the mail flow) end. The additional support plate 16 has, near one end thereof, an exposure source 161 for the print start sensor 151. The print start of the strip-shaped printing substrate is triggered with a delay of a path length $l=D1+\Delta D$ by a control unit (not shown), wherein the distance D1 in the transport direction x is the distance between a light beam L and that nozzle row of the print head of an ink cartridge that is closest to the roller, and wherein the length $\Delta D$ is the distance between the leading edge of the strip-shaped printing substrate and the start of the printing region of the strip-shaped printing substrate, in which indicia are printed.

Shown in FIG. 8*b* is a view of a detail C of the view according to FIG. 8*a*. Each print head has at least one row of nozzles that is situated on a line (not shown) parallel to the y-direction. A first line 101 that intersects the nozzle row, and thereby is situated orthogonal to the aforementioned line with the row of nozzles and parallel to the z-direction, has a distance D1 from a second line 160 on which the light beam L lies which a light emitting diode LE3 emits as an exposure source 161 for the print start sensor. In the exemplary embodiment according to the second variant, the distance D1=25 mm and the roller 3611 has a radius of r=6 mm. The axle 36111 (which axle 36111 is extended in the y-direction) of the roller 3611 of the separate contact pressure device 36 intersects the light beam L which lies on the second line 160 orthogonal to the extended axle 36111. A photosensor FS3 serves as a print start sensor 151 and can detect a light beam interruption. The light emitting diode LED3 sends the light beam L to a photosensor FS3 which outputs a signal which triggers the print start as soon as the leading edge of a mail piece P, thin printing substrate or, respectively, other flat good interrupts the light beam L.

Alternative components (such as phototransistors, photocells and the like or, respectively, infrared light lamps and the like) are usable as a print start sensor 151 or as an exposure source 161 for the print start sensor.

FIG. 9 shows a perspective presentation of a printing apparatus 1 with removed box-shaped module 3, from the front upper left. The floor plate 400 of the lower housing shell 4 of the printing apparatus 1 and the rear wall 40 of the lower housing shell of the printing apparatus form an edge at which a flat placement part 401 for the box-shaped module is molded in the plane of the floor plate of the lower housing shell of the printing apparatus. The flat placement part 401 has the ramp 4011 that begins flat at the front and rises toward the rear and kinematically interacts with the aforementioned deflection arm (not visible from above) of the box-shaped module 3. A protective housing 402 is provided for the sensor support plate, which protective housing 402 protects the sensors from interfering influences due to outside light. The protective housing 402 is arranged on the front wall 40 of the printing apparatus 1.

Figure 10A:
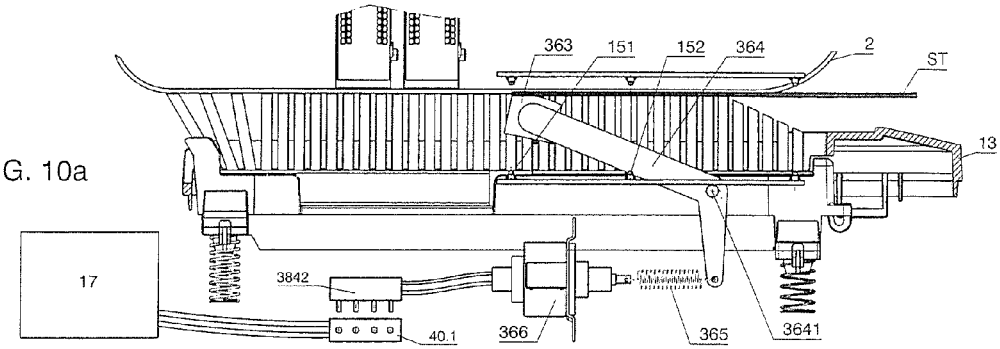
FIG. 10*a* is a view of a longitudinal section through the feed table from the rear, with a contact pressure device for strip-shaped printing substrates according to the third variant, for the case that the box-shaped module is inserted into the printing apparatus.

FIG. 10*a* is a view of a longitudinal section through the feed table from the rear, with a contact pressure body 31 installed on the support receptacle 32, and with a contact pressure device for strip-shaped printing substrates according to the third variant, for the case that the box-shaped module is inserted into the printing apparatus. A skid 363 is arranged at the one end of an angle lever 364 and one end of a tension spring 365 is attached to the other end of the angle lever. The angle lever is borne so as to be pivotable on the axle 3641 borne at the bend of the one lever arm. The other end of the tension spring 365 is attached to one end of a linear step motor 366 that is driven against said step motor 366, whereby the skid 363 presses the strip-shaped printing substrate onto the transport belt 2. The skid comprises a material with a low coefficient of friction μ, for example polytetrafluoroethylene (Teflon) with μ=0.04 to 0.1. The box-shaped module 3 has on its back side of the lower housing shell 384 a plug 3842, and the printing apparatus has a socket 40.1 on the front wall 40 of the lower housing shell 4 of the printing apparatus for the electrical connection of the linear step motor 366 to the control unit 17 of the printing apparatus.

On the support plate 16 for exposure means, three light emitting diodes (LEDs) are arranged at a distance from one another, with which light emitting diodes is respectively associated a light-sensitive sensor on a support plate 15 for sensors, wherein the second light emitting diode LED2 sends a light beam L to a second light-sensitive sensor 152, and wherein the third light emitting diode LED3 sends a light beam L to the print start sensor 151. The second light sensitive sensor 152 can detect a strip-shaped printing substrate ST that has entered into the gap. The linear step motor 366 is now activated by the control unit 17, and the angle lever 364 is pivoted onto the strip-shaped printing substrate ST. The print start sensor 151 detects a light beam interruption by the leading edge of the strip-shaped printing substrate ST when the latter is transported further. Under the assumption that the box-shaped module 3 is inserted into printing apparatus and that an electrical contact is produced between the socket 40.1 of the printing apparatus and the plug 3842, the control unit 17 activates the linear step motor 366 as soon as the second light-sensitive sensor 152 has detected a strip-shaped printing substrate ST. As of a certain desired path point on the transport path, the separate contact pressure element therefore comes to press on a field substrate to be printed, counter to the force of gravity, wherein the linear step motor 366 is controlled accordingly by the control unit of the printing apparatus. The clamping of the strip-shaped printing substrate ST is realized between the skid 363 and the transport belt 2, just before the print start sensor 151 can detect a light beam interruption. The skid 363 is lowered again via a corresponding delayed activation of the linear step motor 366 after the second light-sensitive sensor 152 detects a trailing edge of the strip-shaped printing substrate. Alternatively, the print start sensor 151 can also trigger a lowering of the skid 363. A removal of the box-shaped module from the printing apparatus is only possible after the skid 363 has been lowered again.

Figure 10B:
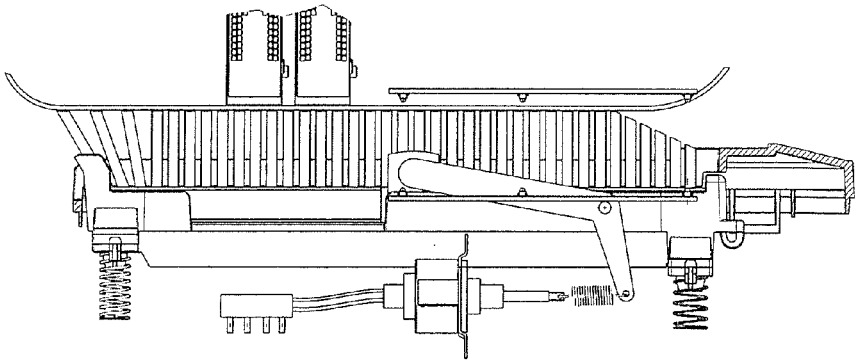
FIG. 10*b* is a view of a longitudinal section through the feed table from the rear, with a contact pressure device for strip-shaped printing substrates according to the third variant, for the case that the box-shaped module is not inserted into the printing apparatus.

In FIG. 10*b* is a view of a longitudinal section through the feed table from the rear, with a contact pressure body installed on the receptacle support, and with a contact pressure device for strip-shaped printing substrates according to the third variant, for the case that the box-shaped module has not been inserted into the printing apparatus, which is why the linear step motor of the box-shaped module cannot be activated by the control unit of the printing apparatus.

A cam shaft was drawn in FIG. 3, and a linear step motor was drawn in FIG. 10*a,b*; however, other alternative positioning means should not thereby be excluded from use according to the invention.

Although modifications and changes may be suggested by those skilled in the art, it is the intention of the inventors to embody within the patent warranted hereon all changes and modifications as reasonably and properly come within the scope of their contribution to the art.

We claim as our invention:

1. A printing apparatus, comprising:

an apparatus housing;

an ink printing device mounted in an upper portion of said apparatus housing;

said apparatus housing having a receptacle therein in a lower portion of said apparatus housing, beneath said ink printing device;

a box-shaped module removably inserted in said receptacle along a y-direction of a Cartesian coordinate system, which also has a z-direction and an x-direction;

said box-shaped module comprising a contact pressure device having a contact pressure body biased to act on flat items, moving in the x-direction between said ink printing device and said contact pressure device, to urge flat items in the z-direction toward said ink printing device, said flat items sometimes being strip-shaped printing substrates;

said contact pressure device comprising a base plate on which said contact pressure body is mounted, said base plate having a notch proceeding through an edge of said base plate in the z-direction, said notch being unobstructed above said notch by said contact pressure body;

an additional contact pressure device for said strip-shaped printing substrates, comprising a contact pressure element mounted and biased in said box-shaped module to selectively move through said notch, from below said notch, to urge said strip-shaped printing substrates, when present, in the z-direction toward said ink printing device; and a sensor that individually detects said flat items as said flat items move in the small x-direction through a sensing region of said sensor, said sensor then triggering printing on the respective flat items dependent on the detection thereof, said sensor being situated in said apparatus housing with said sensing region thereof adjacent, along the y-direction, said contact-pressure element of said additional contact pressure device.

2. A printing apparatus as claimed in claim 1 wherein said contact pressure body comprises a plurality of individual contact pressure elements.

3. A printing apparatus as claimed in claim 1 wherein said additional contact pressure element comprises a roller that is mounted for rotation around an axle proceeding parallel to the y-direction, and wherein said sensor is situated below a line defined by said axle.

4. A printing apparatus as claimed in claim 3 wherein each of said strip-shaped printing substrates comprises a print region that receives indicia printed thereon by said ink printing device, and wherein said contact pressure body comprises a contact pressure body edge coinciding with an edge of said notch, said contact pressure body edge being parallel to the y-direction and downstream from the roller with respect to movement of said flat items in the x-direction, said contact pressure body edge being spaced at a distance in the x-direction from said axle of said roller, and said additional contact pressure device comprising a support element on which said roller is mounted, said support element having a length in the x-direction and said roller having a radius that is less than said length of said support element, and said roller having a width in the y-direction that is at most one third of a width of said print region in the y-direction.

5. A printing apparatus as claimed in claim 3 wherein each of said strip-shaped printing substrates comprises a printing region in which said ink printing device prints indicia, and wherein said ink printing device comprises a plurality of rows of ink-ejecting nozzles, including a first nozzle row that is closest to said roller, and wherein said sensor comprises a light emitter that emits a light beam, said light emitter being mounted on a first support plate in said upper portion of said apparatus housing, and said sensor comprising a light receiver that detects said light beam, said light receiver being mounted on a second support plate in said box-shaped module, and wherein said printing apparatus comprises a control unit connected to said sensor and to said ink printing device, said control unit being configured to initiate printing on a stripped-shaped printing substrate with a delay after a leading edge thereof, proceeding in the x-direction, interrupts said light beam, said delay being defined by a path length based on a sum of a first distance and a additional length, wherein the first distance in the transport direction is the distance between said light beam and the nozzle row of the print head of an ink cartridge that is closest to said roller, and wherein said additional length is a distance between the leading edge of the strip-shaped printing substrate and the start of the printing region of said strip-shaped printing substrate, in which indicia are printed being a time required for said leading length to proceed in said x-direction between said light beam and said first nozzle row, plus a time required for said print region to reach said first nozzle row after said leading edge.

6. A printing apparatus as claimed in claim 3 wherein said additional contact pressure element comprises a support on which said axle is resiliently mounted so as to be deflected counter to a spring bias force provided by said support upon interacting with a respective strip-shaped printing substrate, and a pivotably mounted rocker having a first end to which said support is attached, and an opposite second end that engages a mechanism to pivot said rocker arm to move said support and said roller into and out of said notch along the z-direction.

7. A printing apparatus as claimed in claim 3 wherein the roller is installed such that it can rotate on an axle traveling parallel to the y-direction on an angle plate, wherein the angle plate is provided for mechanical coupling of the roller with a shaft support that can be deflected counter to a spring force of a spring and is attached so as to be pivotable on the underside of a feed table, and is elastically active separate from the contact pressure body upon pressing a strip-shaped printing substrate onto the transport belt; a common opening for the separate contact pressure element and for the contact pressure body is provided in the feed table, and the feed table is installed on a lower housing shell of the box-shaped module, wherein the spring is attached to a floor plate of the lower housing shell of the box-shaped module.

8. A printing apparatus as claimed in claim 7, wherein the spring is a leaf spring that is attached at its one end with an attachment means to an attachment block of the floor plate of the lower housing shell of the box-shaped module, and is freely movable with the other end; a molded part is molded on the underside of the shaft support, which molded part rests on the free end of the leaf spring near said free end; and a deflection arm for force transmission to the leaf spring is provided that can be kinematically coupled with a ramp at a flat placement part on the front wall of the lower housing shell of the printing apparatus upon insertion of the box-shaped module, and the deflection arm has a rotation axis that is oriented parallel to the transport direction x given an installed deflection arm, the deflection arm has a ramp-shaped run-up incline on its single lever arm, which ramp-shaped run-up incline protrudes downward through a slit-shaped opening in the floor plate of the box-shaped module given an installed deflection arm, wherein the opening extends parallel to the y-direction; the deflection arm bears a molded contour that is molded on the side of the deflection arm that is directed upward, wherein the leaf spring rests on the molded contour of an installed deflection arm and is pre-tensioned given a kinematic coupling, wherein the roller pre-tensioned with a spring force is pressed against the transport belt if the shaft support is pivoted upward.

9. A printing apparatus as claimed in claim 1 wherein said additional contact pressure element is configured to apply a pressure to said strip-shaped printing substrates that is greater than a pressure applied to said flat items by said contact pressure body.

10. A printing apparatus as claimed in claim 1, wherein said additional contact pressure element is designed as a skid that is arranged at the one end of an angle lever, one end of a tension spring is attached to the other end of the angle lever, wherein the angle lever is borne pivotable on an axle that is placed at a bend of the one lever arm that has the skid; the other end of the tension spring is attached to one end of a linear step motor, wherein the end of the linear step motor is driven up to the step motor for the movement of the skid; and a plug and a socket are provided for the electrical connection of the linear step motor of the box-shaped module to the control unit of the printing apparatus during the insertion of the box-shaped module into the printing apparatus, wherein the plug is arranged on the back side of the lower housing shell of the box-shaped module and the bushing is arranged on the front wall of the lower housing shell of the printing apparatus.

* * * * *